US007025688B1

(12) United States Patent
Hatzikostantis

(10) Patent No.: US 7,025,688 B1
(45) Date of Patent: Apr. 11, 2006

(54) LASER ALIGNMENT SYSTEM

(76) Inventor: George Hatzikostantis, 4425 Rutledge Dr., Palm Harbor, FL (US) 34685

( * ) Notice: Subject to any disclaimer, the term of this patent is extended or adjusted under 35 U.S.C. 154(b) by 37 days.

(21) Appl. No.: 10/719,637

(22) Filed: Nov. 21, 2003

Related U.S. Application Data

(60) Provisional application No. 60/427,691, filed on Nov. 21, 2002.

(51) Int. Cl.
*A63B 69/36* (2006.01)

(52) U.S. Cl. ..... 473/220; 473/266; 473/270

(58) Field of Classification Search ..... 473/219, 473/220, 266, 270
See application file for complete search history.

(56) References Cited

U.S. PATENT DOCUMENTS 1,545,648 A * 7/1925 Fletcher ..... 473/218
5,465,972 A * 11/1995 Cornett ..... 473/220
5,776,007 A * 7/1998 Kendall et al. ..... 473/220
6,059,668 A * 5/2000 Marley, Jr. ..... 473/220

* cited by examiner

*Primary Examiner*—Raleigh W. Chiu
(74) *Attorney, Agent, or Firm*—Edward P. Dutkiewicz

(57) ABSTRACT

A laser alignment system comprises a rod, a casing removably couplable with respect to the rod, and a laser positioned within the casing.

5 Claims, 4 Drawing Sheets

FIG 1
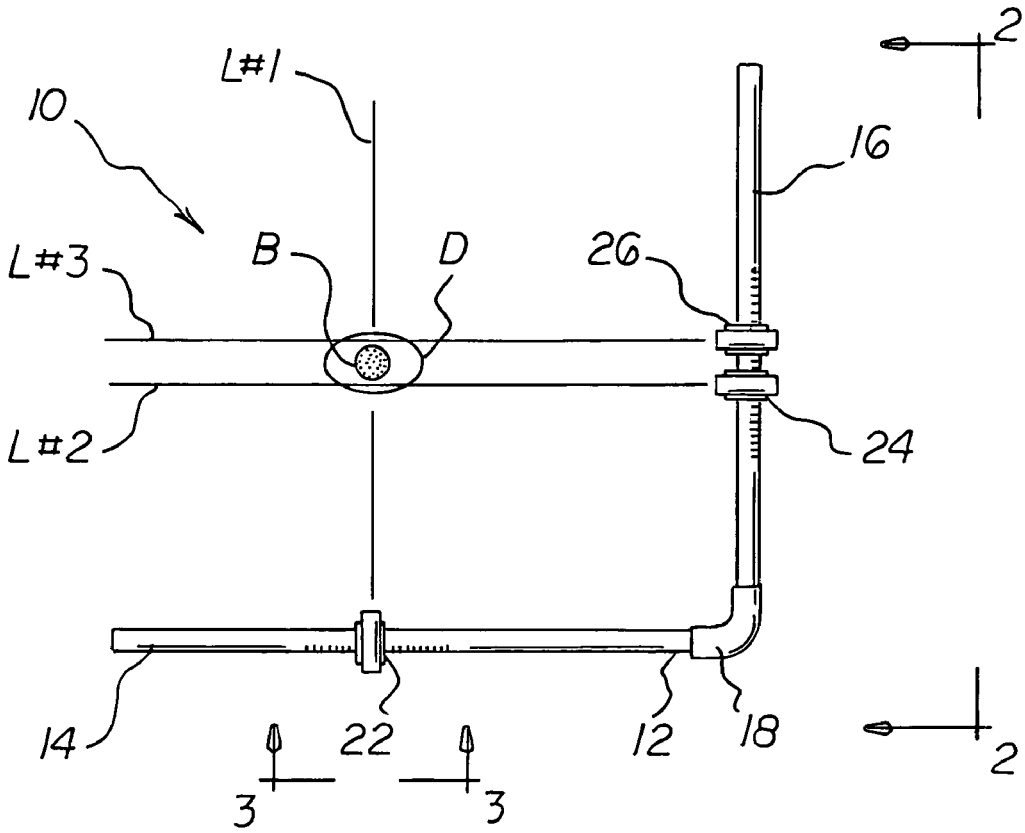
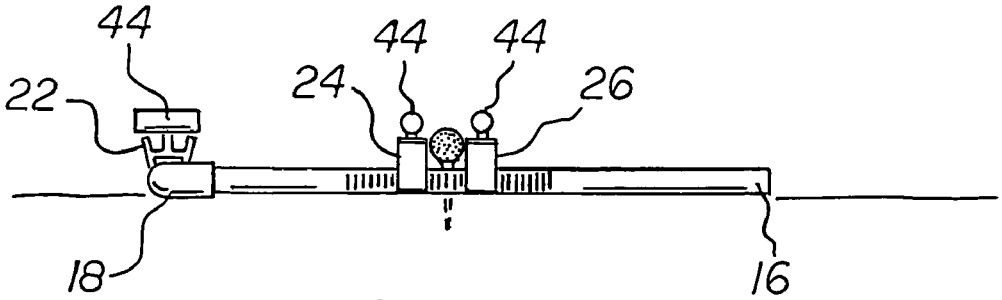
FIG 2

FIG 5
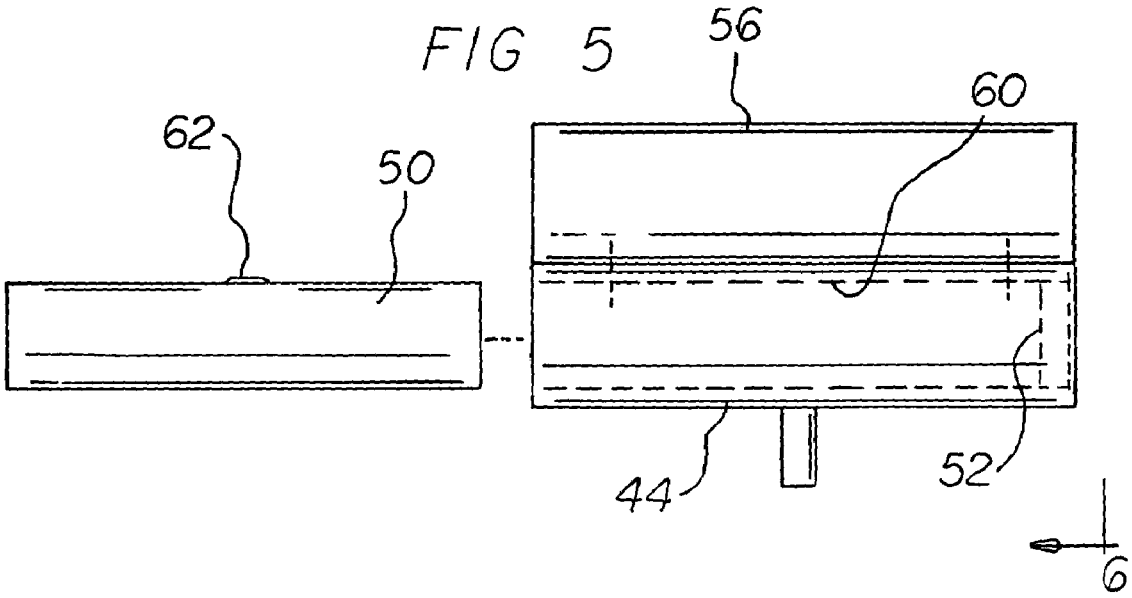
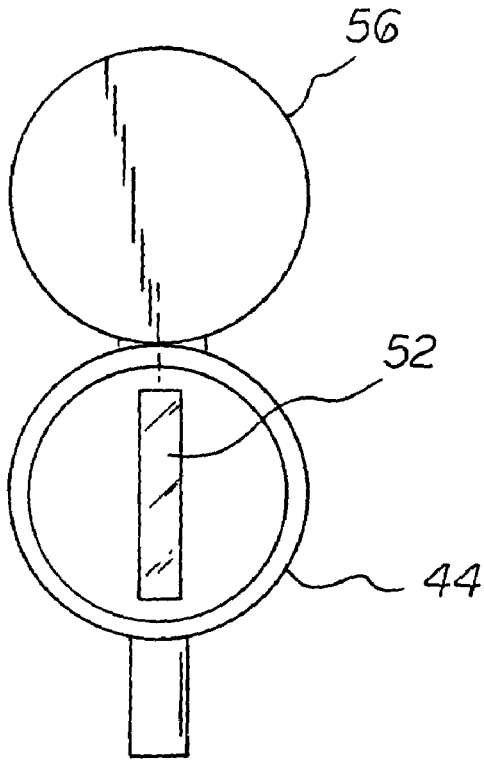
FIG 6

FIG 7
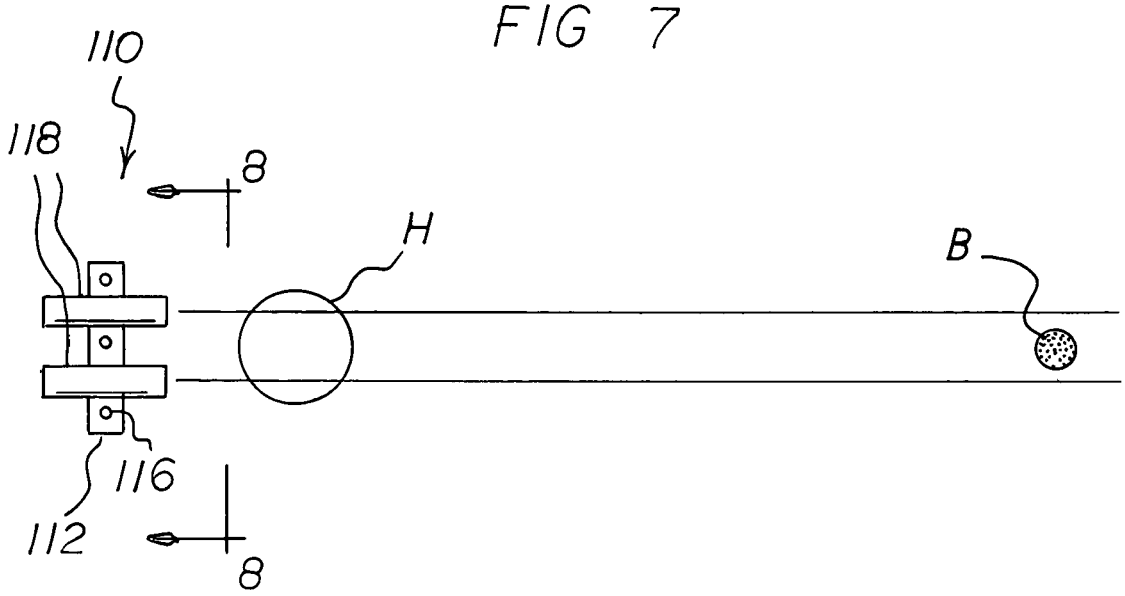
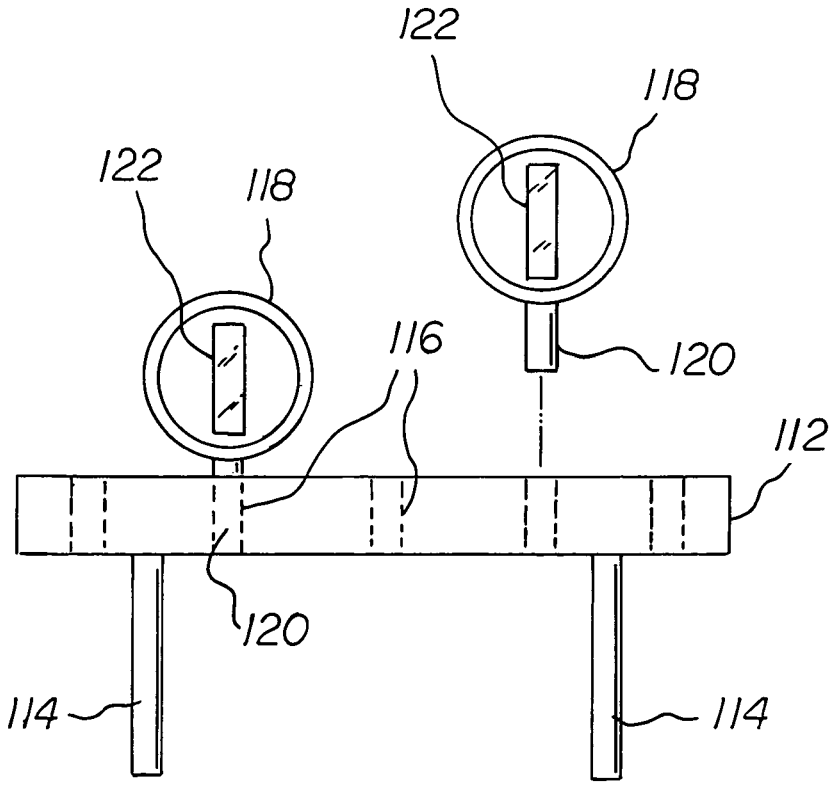
FIG 8

LASER ALIGNMENT SYSTEM

RELATED APPLICATION

This application is based upon Provisional Application Ser. No. 60/427,691 filed Nov. 21, 2002, the subject matter of which is incorporated herein by reference.

BACKGROUND OF THE INVENTION

1. Field of the Invention

The present invention relates to a laser alignment system and more particularly pertains to assisting a golfer in properly squaring a body and a golf face to a target.

2. Description of the Prior Art

The use of golfing aids is known in the prior art. More specifically, golfing aids previously devised and utilized for the purpose of aligning shots are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,007,436 issued Dec. 28, 1999 to Mark relates to a method for employing light from a laser generator beam to assist in aiming a golf ball and apparatus therefor. U.S. Pat. No. 6,071,202 issued Jun. 6, 2000 to Densberger relates to a golf swing training method. Lastly, U.S. Pat. No. 6,375,579 issued Apr. 23, 2002 to Hart relates to a golf swing analysis system and method.

While these devices fulfill their respective, particular objectives and requirements, the aforementioned patents do not describe laser alignment system that allows assisting a golfer in properly squaring a body and a golf face to a target.

In this respect, the laser alignment system according to the present invention substantially departs from the conventional concepts and designs of the prior art, and in doing so provides an apparatus primarily developed for the purpose of assisting a golfer in properly squaring a body and a golf face to a target.

Therefore, it can be appreciated that there exists a continuing need for a new and improved laser alignment system which can be used for assisting a golfer in properly squaring a body and a golf face to a target. In this regard, the present invention substantially fulfills this need.

SUMMARY OF THE INVENTION

In view of the foregoing disadvantages inherent in the known types of golfing aids now present in the prior art, the present invention provides an improved laser alignment system. As such, the general purpose of the present invention, which will be described subsequently in greater detail, is to provide a new and improved laser alignment system and method which has all the advantages of the prior art and none of the disadvantages.

To attain this, the present invention essentially comprises a laser alignment system for assisting a golfer in properly squaring a body and a club face to a target. The system comprises, in combination, a rod assembly fabricated of a primary tube and a secondary tube with a 90 degree elbow joint removably holding the tubes at 90 degrees with respect to each other in a plane on the ground during use. The tubes are circular in cross section with a common diameter.

A plurality of clips include a foot clip and an inner ball clip and an outer ball clip. Each clip has a curved lower gripping portion positionable around a tube to apply a gripping force. Spaced fingers have lower extents secured to the gripping portion to cause a gripping of a pipe by a gripping portion. The spaced fingers have upper extents adapted to be squeezed by a user to release the grip of a pipe by a gripping portion. The spaced fingers having a cross piece coupling the spaced fingers and adapted to act as pivot points during the squeezing and releasing of the upper extents of the fingers. The foot clip is positioned on the primary pipe with the inner and outer ball clips positioned on the secondary pipe. The cross piece has a spacer having a lower end secured to the cross piece and an upper end formed with a recess.

A casing is provided for each clip. Each is formed in a tubular configuration with an interior chamber. A projection is removably positionable in a recess of a clip.

A laser is provided for each casing. Each laser is positioned in a casing and has an associated shutter with a prism-like structure for transforming the dot of a laser output into a laser line.

A battery case is provided for each laser for removably coupling to an associated casing with an associated laser. The battery case is for supplying power to the associated laser.

A depressing mechanism is located within each casing and an associated activation switch on each laser. Each laser is activated by its depressing mechanism upon being slid into a casing and deactivated upon being slid out of a casing.

Stickers are adapted to be adhered to the pipes, The stickers function to indicate to a use a preferred positioning for the clips.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved laser alignment system which has all of the advantages of the prior art golfing aids and none of the disadvantages.

It is another object of the present invention to provide a new and improved laser alignment system which may be easily and efficiently manufactured and marketed.

It is further object of the present invention to provide a new and improved laser alignment system which is of durable and reliable constructions.

An even further object of the present invention is to provide a new and improved laser alignment system which is susceptible of a low cost of manufacture with regard to both materials and labor, and which accordingly is then susceptible of low prices of sale to the consuming public, thereby making such laser alignment system economically available to the buying public.

Even still another object of the present invention is to provide a laser alignment system for assisting a golfer in properly squaring a body and a golf face to a target.

Lastly, it is an object of the present invention to provide a new and improved laser alignment system comprising a rod; a casing removably couplable with respect to the rod; and a laser positioned within the casing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a laser alignment system constructed in accordance with the principles of the present invention.

FIG. 2 is a side elevational view of the system taken along line 2—2 of FIG. 1.

FIG. 5 is an exploded side elevational view of the casing, battery case as well as the laser, prism and casing shown in the prior FIG. 5.

FIG. 6 is an end elevational view taken along line 6—6 of FIG. 5.

FIG. 7 is a plan view of a ground adapter system constructed in accordance with an alternate embodiment of the invention.

FIG. 8 is a front elevational view taken along line 8—8 of FIG. 7.

The same reference numerals refer to the same parts throughout the various Figures.

DESCRIPTION OF THE PREFERRED EMBODIMENT

Figure 3:
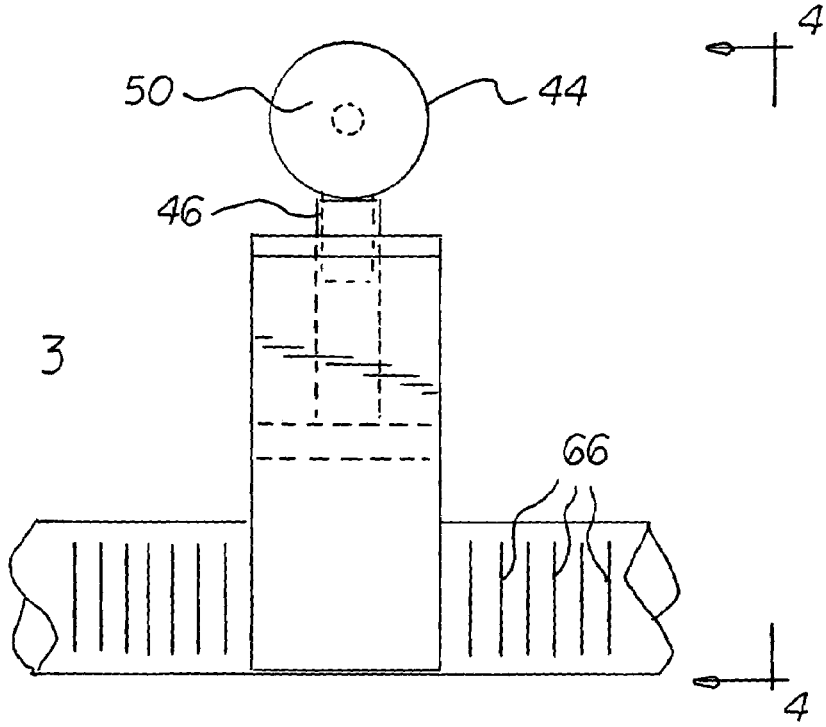
FIG. 3 is a front elevational view of the system taken along line 3—3 of FIG. 1.

With reference now to the drawings, and in particular to FIG. 1 thereof, the preferred embodiment of the new and improved laser alignment system embodying the principles and concepts of the present invention and generally designated by the reference numeral 10 will be described.

The present invention, the laser alignment system 10 is comprised of a plurality of components. Such components in their broadest context include a rod, a casing and a laser. Such components are individually configured and correlated with respect to each other so as to attain the desired objective.

More specifically, the present invention is a laser alignment system 10 for assisting a golfer in properly squaring a body and a club face to a target. The system comprises, in combination, a rod assembly 12 fabricated of a primary tube 14 and a secondary tube 16. A 90 degree elbow joint 18 removably holds the tubes at 90 degrees with respect to each other in a plane on the ground during use. The tubes are preferably circular in cross section with a common diameter. The tubes and joint are preferably fabricated of plastic such as polyvinyl chloride.

A plurality of clips 22, 24, 26 include a foot clip 22 and an inner ball clip 24 and an outer ball clip 26. Each clip has a curved lower gripping portion 28 positionable around a tube to apply a gripping force. Spaced fingers 30 have lower extents 32 secured to the gripping portion to cause a gripping of a pipe by a gripping portion. The spaced fingers have upper extents 34 adapted to be squeezed by a user to release the grip of a pipe by a gripping portion. The spaced fingers having a cross piece 36 coupling the spaced fingers and adapted to act as pivot points during the squeezing and releasing of the upper extents of the fingers. The foot clip is positioned on the primary pipe with the inner and outer ball clips positioned on the secondary pipe. The cross piece has a spacer 38 having a lower end secured to the cross piece and an upper end formed with a recess 40. The clips are preferably fabricated of plastic such as polyvinyl chloride.

A casing 44 for each clip is next provided. Each casing is formed in a tubular configuration with an interior chamber. Each casing has a projection 46 removably positionable in a recess of a clip.

A laser 50 is next provided for each casing. Each laser is positioned in a casing. Each laser has an associated shutter with a prism-like structure 52 for transforming the dot of a laser output into a laser line.

Also provided is a battery case 56 for each laser. Each battery case is for removably coupling to an associated laser for supplying power to the associated laser.

Located within each casing is a depressing mechanism 60. There is an associated activation switch 62 on each laser whereby each laser is activated by its depressing mechanism upon being slid into a casing and deactivated upon being slid out of a casing.

Lastly, stickers 66 are adapted to be adhered to the pipes to indicate to a use a preferred positioning for the clips.

An alternate embodiment of the invention is illustrated in FIGS. 7 and 8. The laser alignment system 110 comprises a rod 112. Such rod has a plurality of primary projections 114 below. Such projections are adapted to be inserted into the ground. In addition, a plurality of recesses 116 are above. A casing 118, having a secondary projection 120 below, is couplable with respect to a recess of the rod. Lastly, a laser 122 is positioned within the casing. The laser is adapted to project at least one line between a target formed as a hole H and a ball B to be hit toward the hole.

In one alternate embodiment, two casings, each one with a laser, are coupled to a single rod for projecting two parallel lines as a tunnel from the hole to the ball for aligning a putt.

In another alternate embodiment, one casings, with one laser, is coupled to a single rod for projecting one beam of light from the ball to the hole for aligning a putt.

FIG. 1 shows the complete system of the primary embodiment. The purpose of the system is to help the user properly square the body and the club face to the target. Unlike other help aids, the present system provides a constant line on the ground and the user can swing through and hit the ball without being obstructed. Also, by analyzing the divot D, all aspects of the club path can be easily monitored. For example, laser line #1 indicates whether the club is hitting the ground before or after the ball. Laser lines #2 with laser line #3 indicates whether the club is on an inside-out or an outside-in path. Although every club face must be square at address, not all golfers have the same swing. Therefore, the user can mark their most effective position, preferably by using stickers, and then clip the lasers to the club. This feature allows the user to quantify and practice his/her specific swing. Because the lasers can be clipped to shorter rods, the present system can also be used as putting rods.

Figure 4:
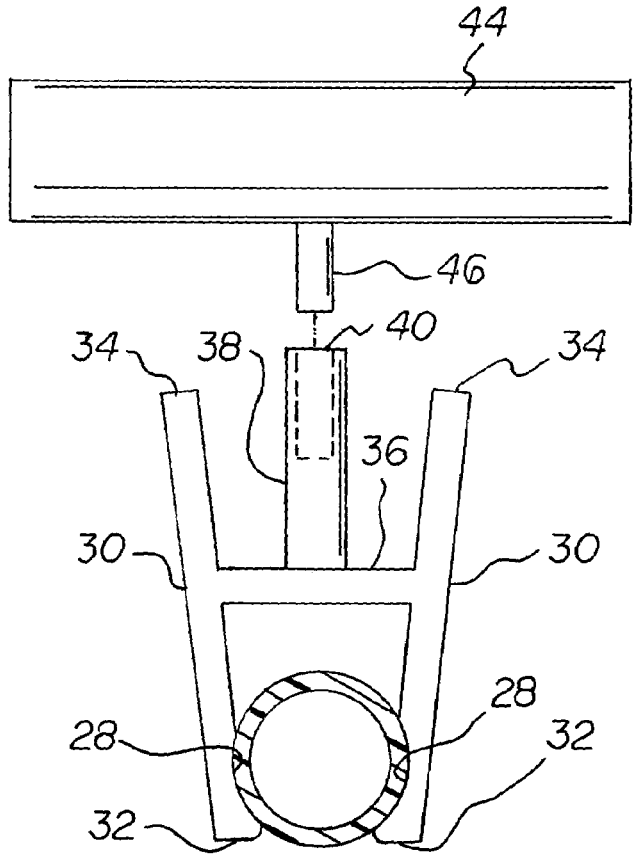
FIG. 4 is an exploded side elevational view of the clip and laser casing taken along line 4—4 of FIG. 3.

FIGS. 3 and 4 show the laser casing and the clip. The laser casing is preferably tubular or rectangular. The laser casing can be built in or it can be a separate unit from the case. If the laser is a separate unit, it is simply inserted into the back of the casing and activated by a mechanism that depresses the switch, as shown in FIG. 5. The casing simply slaps onto the clip.

FIGS. 5 and 6 depict the front and top of the casing. The front may be provided with a movable shutter with a prism-like structure. When the shutter is closed, the prism transforms the laser dot into a laser line. The prism can also be made to fit directly onto the laser.

FIGS. 7 and 8 show the ground adapter system constructed in accordance with an alternate embodiment of the invention. Such adapter system allows the laser to be put directly into the ground. The lasers simply snaps into the designated recesses, and the adapter system is put into the ground. This feature can be used for putting practice as well. The user can use multiple lasers onto the ground adapter system to form a putting "alley". The user can set the adapter system from the hole to the ball. In the alternative, a single laser may be used. If such single laser is used and located behind the ball, it must be positioned sufficiently high above the ball and putter whereby the laser line may illuminate the ground in front of the ball.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A laser alignment system for assisting a golfer in properly squaring a body and a club face to a target comprising, in combination:

a rod assembly fabricated of a primary tube and a secondary tube with a 90 degree elbow joint removably holding the tubes at 90 degrees with respect to each other in a plane on the ground during use, the tubes being circular in cross section with a common diameter;

a plurality of clips including a foot clip and an inner ball clip and an outer ball clip, each clip having a curved lower gripping portion positionable around a tube to apply a gripping force and with spaced fingers having lower extents secured to the gripping portion to cause a gripping of a pipe by a gripping portion, the spaced fingers having upper extents adapted to be squeezed by a user to release the grip of a pipe by a gripping portion, the spaced fingers having a cross piece coupling the spaced fingers and adapted to act as pivot points during the squeezing and releasing of the upper extents of the fingers, the foot clip being positioned on the primary pipe with the inner and outer ball clips positioned on the secondary pipe, the cross piece having a spacer having a lower end secured to the cross piece and an upper end formed with a recess;

a casing for each clip, each casing being formed in a tubular configuration with an interior chamber and a projection removably positionable in a recess of a clip;

a laser for each casing, each laser being positioned in a casing and having an associated shutter with a prism-like structure for transforming the dot of a laser output into a laser line;

a depressing mechanism located within each casing and an associated activation switch on each laser whereby each laser is activated by its depressing mechanism upon the laser being slid into a casing and deactivated upon the laser being slid out of a casing; and stickers adapted to be adhered to the pipes to indicate to a use a preferred positioning for the clips.

2. A laser alignment system comprising:

a primary tube and a secondary tube with a 90 degree elbow joint removably holding the primary and secondary tubes at 90 degrees with respect to each other in a plane on the around during use, the tubes being circular in cross section and with a common diameter;

two casings, each one with a laser, coupled to the secondary tube for projecting two parallel lines as a tunnel for aligning a putt; and one casing, with one laser, coupled to the primary tube for projecting one beam of light for aligning a putt.

3. The system as set forth in claim 2 and further including:

a depressing mechanism located within the casing and an associated activation switch on the laser whereby each laser is adapted to be activated by its depressing mechanism upon being slid into the casing and deactivated upon being slid out of a casing.

4. The system as set forth in claim 2 and further including:

stickers adapted to be adhered to the rod to indicate to a use a preferred positioning for the laser.

5. The system as set forth in claim 2 and further including:

a clip between the casing and the rod, the clip having a curved lower gripping portion positionable around the rod to apply a gripping force and with spaced fingers having lower extents secured to the gripping portion to cause a gripping of a pipe by a gripping portion, the spaced fingers having upper extents adapted to be squeezed by a user to release the grip of a pipe by a gripping portion, the spaced fingers having a cross piece coupling the spaced fingers and adapted to act as pivot points during the squeezing and releasing of the upper extents of the fingers, the foot clip being positioned on the primate pipe with the inner and outer ball clips positioned on the secondary pipe, the cross piece having a spacer having a lower end secured to the cross piece and an upper end formed with a recess.

* * * * *